US005199167A

United States Patent [19]

Desazars de Montgailharo et al.

[11] Patent Number: 5,199,167

[45] Date of Patent: Apr. 6, 1993

[54] METHOD OF MANUFACTURE OF MINIATURE DISPENSER

[75] Inventors: William Desazars de Montgailharo, Paris; Jean-Louis Bougamont, Eu, both of France

[73] Assignee: Societe Francaise d/Aerosols et de Bouchage, Escarbotin, France

[21] Appl. No.: 809,634

[22] Filed: Dec. 17, 1991

Related U.S. Application Data

[62] Division of Ser. No. 547,724, Jul. 2, 1990, Pat. No. 5,102,018.

[30] Foreign Application Priority Data

Jul. 4, 1989 [FR] France ..... 89 08941

[51] Int. Cl.[5] ..... B21D 53/00

[52] U.S. Cl. ..... 29/888.02; 29/469; 29/525

[58] Field of Search ..... 29/888.02, 450, 469, 29/525; 222/251, 320, 321, 372, 378, 383, 385, 387; 215/272

[56] References Cited

U.S. PATENT DOCUMENTS

| | | | |
|---|---|---|---|
| 3,228,571 | 1/1966 | O'Donnell et al. | 222/385 X |
| 3,627,206 | 12/1971 | Boris | 222/385 X |
| 3,774,849 | 11/1973 | Boris | 222/321 X |
| 4,144,987 | 3/1979 | Kishi | 222/385 X |
| 4,174,790 | 11/1979 | Nazawa et al. | 222/315 X |
| 4,311,255 | 1/1982 | Meshberg | 222/321 X |
| 4,420,096 | 12/1983 | Kirk, Jr. | 222/321 X |
| 4,435,135 | 3/1984 | Knickerbocker | 222/321 X |
| 4,964,547 | 10/1990 | Linz | 222/321 X |
| 4,991,747 | 2/1991 | Van Brocklin | 222/385 X |

*Primary Examiner*—Joseph M. Gorski
*Assistant Examiner*—S. Thomas Hughes
*Attorney, Agent, or Firm*—Pennie & Edmonds

[57] ABSTRACT

A liquid dispensing device having a pump carrying the internal mechanism disposed in a container part of the device. The pump has a flange which rests on the upper edge of the container and which is connected to an outer bush member. The bush member is fitted on an outer bearing surface of the wall of the container in radial sealing engagement therewith. The pump includes a venting passageway for connecting the interior of the container to the atmosphere during dispensing of the liquid. In assembling the device, the pump and bush member are first connected together and then connected to the container with the pump in a position to maintain the passageway open to the interior of the container.

6 Claims, 1 Drawing Sheet

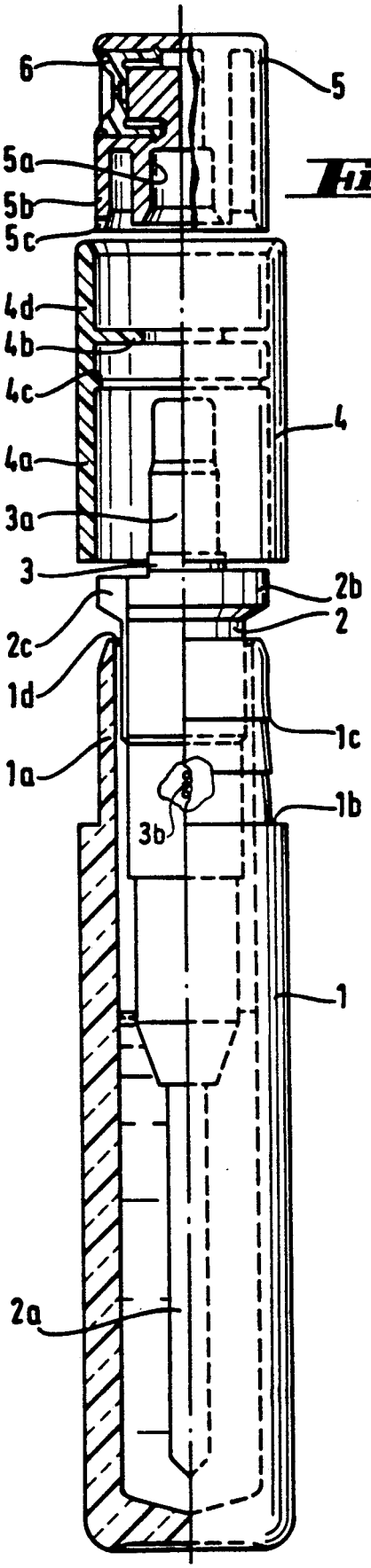
Fig. 1
Fig. 2
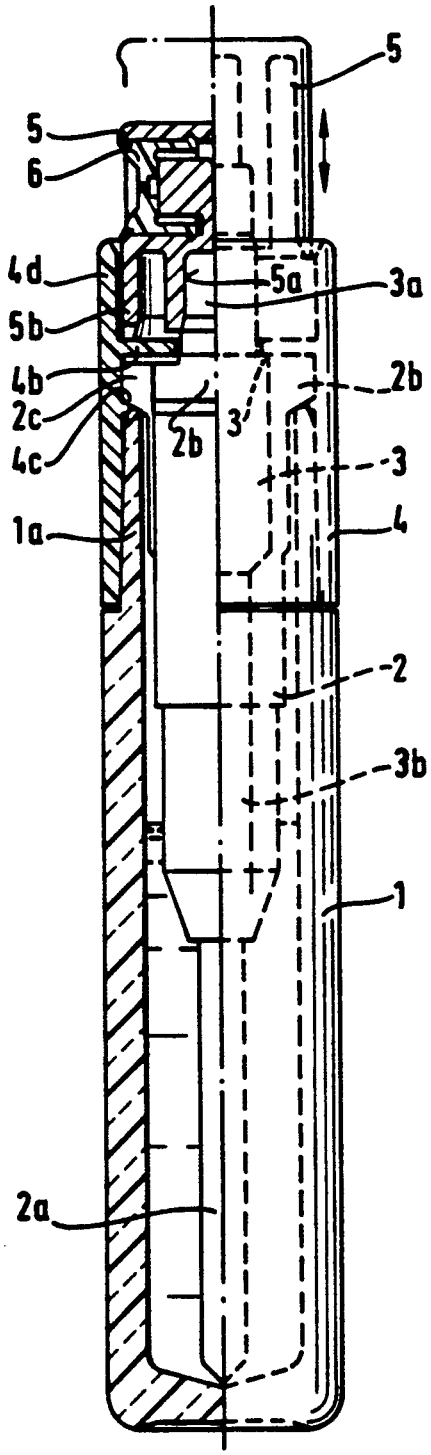

METHOD OF MANUFACTURE OF MINIATURE DISPENSER

This is a division of application Ser. No. 07/547,724, filed Jul. 2, 1990, now U.S. Pat No.5,102,018.

BACKGROUND

The invention relates to dispensing devices e.g. intended for the distribution of medicaments used in very small doses or to the distribution of perfume samples. Such devices are designed around known miniature dosing pumps with a piston carrying an axial movable nozzle and whose body substantially has a diameter of approximately 7 mm for a length of approximately 3 cm, under an assembly collar projecting by approximately 1 mm, but which is not necessarily circular, whereby their outer volume may not exceed 4 or 5 $cm^3$, with a diameter of approximately 10 to 12 mm, while their capacity varies between about 50 and 10 doses, i.e. drops to 1 ml.

The above type structure makes it possible to construct such devices in very large numbers at very low cost. It can also apply to slightly larger models, but its characteristics would then generally lose part of their interest.

Known dispensing devices include a pump carrying the internal mechanism disposed in a container part of the device. The pump has a flange which rests on the upper edge of the container and which is connected to an outer bush member. The bush member is fitted on an outer bearing surface of the wall of the container. A construction of the surface of the wall of the container. A construction of the type just described is the subject of U.S. Pat. No. 4,311,255. There, the bush member forms a can covering the entire length of the container.

The adoption of a generally cylindrical shape for the container and for the bush member makes it possible to make them from synthetic materials and more generally thermoplastic materials, which are injection molded in the same way as most of the pump components. If the container fits along the pump in glove finger-like manner, it leads to minimum transverse dimensions. Unlike other assembly methods, this method enables the cross-section of the device to slightly vary from a circular contour, while retaining a substantially uniform thickness of the wall.

The assembly only exerts easily withstood compressive stresses on the components, and with regard to such small components, the precision inherent in injection molding makes it possible to bring about a substantially non-dismantlable, tight assembly.

The assembly of the device can take place on an already filled container using existing machines, after a small number of modifications have been made, by engaging the bush member to which the pump has already been attached to form a sub-unit. In order to facilitate the assembly operation, the bush member can carry a ring locking the collar of the pump to the bush member.

Numerous materials are available and they will be chosen as a function of the product to be stored and will preferably be relatively rigid in order to avoid deformations, but without creating excessive local stresses.

One obstacle to be overcome in the assembly of the parts of the dispensing device is the obvious need of evacuating the occluded air from the container as the bush member and pump are assembled into the container. For this purpose, the prior art device, such as show in U.S. Pat. No. 4,311,255, have constructed the container part or bush member with interfacing longitudinal grooves through which the air can escape from the container during assembly of the device. With such constructions, the container and bush member are sealed at the end of the assembly operation by axial abutment of the upper end of the container against an upper cover wall of the bush member.

This solution has apparently not been industrially realized. The reason for this may be that the inversion of the curvature created on the wall of the container to form the grooves makes it necessary to reinforce the latter, which is not very acceptable in the case of miniature devices. Also, it would be difficult to obtain the precision necessary for the final sealing on the abutting end of the grooves.

SUMMARY OF THE INVENTION

The present invention is based on the discovery that specific air evacuation passages or grooves are not necessary in the case of pumps constructed with conventional venting passageways used in conjunction with the normal dispensing of liquid from the container. Such venting passageway exists in order to enable the air to enter the container during each dispensing operation of the pump in order to balance the pressure inside the container.

In accordance with the present invention, the venting passageway of the pump is artificially opened during assembly of the device in order to make it fulfill a reverse air venting function rather than its normal air filling function. Thus, the radially engaging bearing surfaces of the base member and container wall can retain the same and preferably convex contour and do not require the air grooves of the prior art constructions. This leads to a significant diameter saving on the overall diameter of the device, but in particular an increase in strength, precision and therefore ease of assembly.

DESCRIPTION OF THE DRAWINGS

FIG. 1 is an exploded side view of the dispensing device with the left side thereof shown in cross-section; and FIG. 2 is a side view of the assembled device with the left side thereof shown in cross-section.

DESCRIPTION OF THE PREFERRED EMBODIMENT

The dispensing device (sprayer or atomizer) has a container formed by a narrow tube 1 which in the present case is made from transparent polyethylene terephthalate. The tube has a circular cross-section, which is injection molded and cylindrical at its lower end. The thickness of the wall is reduced in its upper end 1*a*, so as to form a very slightly conical outer bearing surface terminating in an outer shoulder 1*b* where it meets the lower end.

The tube receives a pump with a small lateral clearance. The pump has successive cylindro-conical ferrules of revolution and terminates at its lower end with an integrated fill tube 2*a*. The pump carries at its upper end a collar 2*b*; and both the pump at its upper end and the collar have at least one groove 2*c* serving as a vent passageway for the container. The pump 2 contains the mechanism of the piston 3, whose rod 3*a* constitutes the pump nozzle. The piston 3 closes the vent passageway 2*c* against communication with the atmosphere in the inoperative state of the pump, as more fully described below.

The pump and container are covered by a cylindrical bush member 4, which is also injection molded and in the present case is made from polyamide. The bush member has a skirt 4a with the same outer contour as the lower end of the tube 1, offering on its inner face a bearing surface, whose conicity corresponds to that of the corresponding bearing surface of the tube end 1a. The bush member is closed toward its upper end by a radial inwardly extending flange 4b. The flange has a central opening through which the nozzle of the pump extends. In the present case, the bush member also extends upwardly from the flange 4b to form a ferrule 4d.

The inner face of the skirt 4a of the bush member is smooth, with the exception of a locking ring 4c, whose function will become apparent hereinafter and which must not prevent the extraction of the die from the mold. With certain materials and preferably by using a shell mold, the outer face of the upper part 1a of the tube can, as shown in the right-hand part of FIG. 1, carry sealing ribs 1c. However, it is not necessary to have them here due to the strength of the materials used and if they lead to objectionable external appearance deficiencies.

An atomizing head 5 carrying a spraying means 6 is placed on the nozzle 3a by means of a seat 5a, masked by the lower skirt 5b. The skirt 5b extends further downwardly than the seat 5a and is provided with at least one air passageway or groove 5c.

During assembly, the parts can be placed on the tube in the stacked order shown in FIG. 1 and can be directly assembled by pressing the bush member over the container after the pump has been inserted into the container. However, this would assume that the container was filled with liquid, so that the complete assembly would take place at this stage on the premises of the user. Alternatively, the device can be assembled empty and then filled by intrusion, which is relatively inappropriate in the case of plastic containers with a small capacity.

In accordance with the present invention, the assembly operation is effected by first assembling the pump 2 separately to the bush member 4 to form a sub-unit. More particularly, the bush member is first fit onto the pump 2, so that the mechanism of the piston 3 is sealed against the flange 4b forming the cover and the nozzle 3a passes through the axial opening in the flange. The pump is held in this position by the collar 2b being engaged by the locking ring 4c. This is the same position of these parts as they have in the inoperative position of the dispensing device as shown in the right-hand side of FIG. 2. In this position, the seating of the piston to the flange by its internal spring 3b closes the passageway 2c against communicating with the atmosphere.

The sub-unit of the connected pump and bush member can then be placed on the container 1 which has previously been filled with the desired product dose. The assembly in this manner ensures the definitive fixing and cone-to-cone sealing of the facing surfaces of the upper end 1a of the container and the skirt 4a of the bush member 4. In the final assembled position, the locking ring 4c is disposed between the collar 2b and the rim 1d of the tube as shown at the left of FIG. 2.

In the left-hand part of FIG. 2, the device is shown in the operating position of the dispenser. The lowered head 5 has served as a plunger for the nozzle 3a in order to force down the piston. Till this position of the parts, the container is linked with the atmosphere for permitting entry of air into the container 1 as the liquid is dispensed. The travel has been limited by the contacting of the skirt 5b of the heads with flange 4b.

The right-hand part of FIG. 2 shows the external appearance of the assembled dispenser in the inoperative state. Here, the various internal members are shown in dotted line form, the ferrule 4d just covering the edge of the skirt 5b of the head. Return to the upper position is effected by the internal spring 3b of the piston 3, which in turn tightly abuts against the cover formed by the flange 4b for closing off communication between the atmosphere and the venting passageway 2c from the container.

The lowered position of the piston as shown in the left side of FIG. 2 is also used for assembly of the pump and bush member to the container. During this operation, the connected pump 2 and bush member 4 sub-unit is seized by a vertically moving mandrel of an assembling machine. This mandrel places the sub-unit on the top of the tube 1 with the pump extending into its open end. In doing this, the mandrel will first bear on the nozzle and therefore the piston 3, rather than the actual bush member. As the skirt 4a of the bush member starts its telescoping movement over the wall 1a of the tube, a frictional resistance of their facing, bearing surfaces to further downward movement of the bush member 4 is created. This causes the piston to give way and move away from sealing engagement with the flange 4. This, in turn opens the vent passageway 2c of the pump to connect the inner space of the container to atmosphere. With this connection of the inner space of the container to atmosphere, the bush member 4, and in particular the skirt 4a, can then be slid over the upper end wall 1a of the tube 1 while in radial sealing engagement therewith and the air initially entrapped in the container and bush member allowed to escape to atmosphere.

During the assembly movement, the bush member is held in the assembling machine against upward movement by engagement with a suitable abutment in the machine. This makes it possible to transmitt to the bush member the fitting force necessary for moving it fully onto the upper part 1a of the tube, while avoiding any overloading of the mechanism, until the collar 2b abuts against the rim 1d of the wall 1a. In this final position, the skirt 4a leaves a randomly variable axial clearance at the shoulder 1b, while the radial sealing engagement of the facing surfaces of the skirt 4a and upper part 1a of the tube makes the assembly tight and quasi-irreversible.

With the above described assembly procedure, it is not necessary to provide any grooving in either the skirt of the bush member or in the upper end of the tube. The position of the parts during the assembling operation is instead made the same as occurs during the normal dispensing operation when the atomizing head 5 is depressed by the user of the device.

Although the assembling operation takes place on a tube already filled with liquid, the fitting of the bush member seals the assembly without the free volume of the container leading to an abnormal rise in its internal pressure, since the venting mechanism of the pump is held open.

As an alternative, it is pointed out that the atomizing head 5, which is of a known type, could be put into place in the upper end of the bush member 4 at the start of assembly and, thus take the place of a specific pressing tool on the mandrel for depressing the pump. The head thus fulfills the function described hereinbefore via the abutment limiting the travel of the piston on the pump. This could also apply with respect to a head with a skirt on the outside of the bush; but this would mean an increased overall dimension. The passageway 5c maintains communication of the interior of the tube with the atmosphere in this position of the head. However, with regards to the transmission of forces, a direct engagement of the mandrel with the pump during the assembly operation with subsequent attachment of the head, is preferred.

Finally, to avoid the expulsion of a certain liquid quantity through the nozzle, it is preferable to use a pump able to withstand a certain overpressure of the container by sealing at least one of its joints, e.g. the slide-valve-type admission joint or more conventionally an exhaust joint able to create a precompression.

The cylindrical shape of revolution of the dispensing device is as compact as possible, the length of the tube 1 determining the internal volume, obviously with adaptation of the fill tube 2a. Despite the assembly of the device being very simple, it is effective and entirely tight in the inoperative state.

We claim:

1. In the method for the assembly of a dispenser having a piston pump disposed in a container and carrying an axially moveable nozzle extending outside of the container, the pump having a collar resting on an upper edge of the container and fixed beneath an inner flange of an outer bush member, the bush member having a lower skirt surface frictionally engaging with an outer bearing surface of an outer wall of the container, the flange of the bush member having a central opening through which a nozzle part of the pump extends for reception in an atomizing head, the engaging surfaces of the skirt and container wall having the same facing contour and being in radial sealing contact over their entire circumferential periphery, and the pump having a venting mechanism for temporarily connecting the interior of the container to the atmosphere, said method comprising the steps of initially assembling the pump to the bush member to form a sub-unit and then assembling the sub-unit to the container filled with a product dose, the fitting of the bush member to the container wall ensuring a final sealing of the container against communication with the atmosphere, the improvement characterized in that the method includes the steps of applying an axial force directly or via an atomizing head, against the nozzle of the pump to lower the pump into the container and the bush member onto the wall of the container, an axial frictional resistance of the bush member to the lowering on the container wall caused by engagement of the engaging surfaces of the skirt of the bush member and the container wall causing said piston to move axially relative to the bush member to open the venting mechanism of the pump; discontinuing said relative axial movement; and applying an axial fitting force to the bush member in order to move it onto the upper part of the container until a fully assembled engagement is obtained in order to bring about a tight assembly and said final sealing of said container.

2. The method of assembling a liquid dispenser comprised of an open-ended container for holding a liquid to be dispensed, a pump having an axially moveable piston, a venting mechanism operable between opened and closed positions for controlling air communication between the interior of the container and the atmosphere, an outer bush member disposed in sealing engagement over the open end of the container, and an axially moveable nozzle disposed above the container and extending axially through the bush member and into communication with the atmosphere for dispensing the liquid upon axial movement of the nozzle against the piston to move the piston axially and pump fluid through the nozzle while the venting mechanism is open to connect the interior of the container to the atmosphere and permit air to enter the container as liquid is dispensed therefrom, the method of assembly comprising the steps of:

a) connecting the pump to the bush member to form a sub-unit, and b) assembling the sub-unit onto the container with the bush member in radial sealing engagement with the container during such assembly while maintaining the venting mechanism open to connect the interior of the container with the atmoshere.

3. The method of assembling a liquid dispenser comprised of an open-ended container for holding a liquid to be dispensed, a pump having a piston moveable along an axial path, an air passageway between the pump and container for connecting the interior of the container to the atmosphere, an outer bush member disposed in radial sealing engagement over the open end of the container, and sealingly engaging the piston of the pump when the latter is located at one position along its axial path of movement to close a venting passageway and isolate the interior of the container from the atmosphere, and an axially moveable nozzle disposed above the container and extending axially through the bush member and into communication with the atmosphere for dispensing the liquid upon axial movement of the nozzle against the piston to move the piston along its axial path, the movement of the piston being effective to pump fluid through the nozzle and to simultaneously move the piston away from the one position in sealing engagement with the bush member to open the air passageway and thereby connect the interior of the container to the atmosphere to permit air to enter the container as liquid is dispensed therefrom, the method of assembly comprising the steps of:

a) connecting the pump to the bush member to form a sub-unit, and b) assembling the sub-unit onto the container with the bush member in radial sealing engagement with the container during the assembly while maintaining the piston out of sealing engagement with the bush member and the air passageway thereby open to atmosphere.

4. The method according to claim 3 wherein the assembly of the sub-unit to the container includes the steps of:

a) first applying an axial force directly against the pump to move it into the container and the bush member toward the container, until the bush member first engages with the container;

b) continuing the application of the axial force against the pump while holding the bush member against further axial movement to cause the pump to move axially relative to the bush member and unseal the piston from the flange of the bush member; and c) applying an axial force to the bush member after the piston has been unsealed and simultaneously to the pump to move them together into fully assembled condition onto the container.

5. The method according to claim 4 wherein the axial force is applied to the pump is step c) indirectly through the bush member engaging with the pump.

6. The method of assembling a liquid dispenser according to claim 5 wherein the dispenser further includes an atomizing head attached to the nozzle of the pump, the method further comprising the step of assembling the head onto the nozzle after the assembly of the sub-unit to the container.

* * * * *

UNITED STATES PATENT AND TRADEMARK OFFICE

CERTIFICATE OF CORRECTION

PATENT NO. : 5,199,167
DATED : April 6, 1993
INVENTOR(S) : Desazars de Montgailhard It is certified that error appears in the above-indentified patent and that said Letters Patent is hereby corrected as shown below:

On the Title page, item [54] and [19] inventor should read as follows: --William Desazars de Montgailhard;

Column 1, line 33 to 34, delete "A construction of the surface of the wall of the container".;

Column 1, line 68, change "device" to --devices--.

Signed and Sealed this

Twenty-first Day of December, 1993

*Attest:*

Bruce Lehman

BRUCE LEHMAN

*Attesting Officer*

*Commissioner of Patents and Trademarks*